US007520020B1

(12) United States Patent
Hutchens

(10) Patent No.: US 7,520,020 B1
(45) Date of Patent: Apr. 21, 2009

(54) APPARATUS FOR CLEANING A BEVERAGE CAN'S TOP

(76) Inventor: Jack L. Hutchens, 6804 Corsica Dr., Memphis, TN (US) 38120-3412

( * ) Notice: Subject to any disclaimer, the term of this patent is extended or adjusted under 35 U.S.C. 154(b) by 1028 days.

(21) Appl. No.: 10/891,756

(22) Filed: Jul. 15, 2004

(51) Int. Cl.
*A47L 5/36* (2006.01)

(52) U.S. Cl. ..... 15/310; 15/304; 15/311

(58) Field of Classification Search ..... 15/304, 15/310, 311, 316
See application file for complete search history.

(56) References Cited

U.S. PATENT DOCUMENTS

| | | | | |
|---|---|---|---|---|
| 3,117,726 | A | 1/1964 | Schoberg | |
| 3,665,547 | A * | 5/1972 | Boylan | 15/406 |
| 4,027,355 | A * | 6/1977 | Mead et al. | 15/310 |
| 4,183,115 | A | 1/1980 | Zakarian | |
| 4,324,265 | A * | 4/1982 | Fauth | 134/82 |
| 4,364,147 | A | 12/1982 | Biedermann et al. | |
| 4,951,344 | A | 8/1990 | Alkhato | |
| 5,279,017 | A * | 1/1994 | Foreshew | 15/304 |
| 5,991,966 | A | 11/1999 | Sproule | |

* cited by examiner

*Primary Examiner*—Joseph J Hail, III
*Assistant Examiner*—Shantese McDonald
(74) *Attorney, Agent, or Firm*—Walker, McKenzie & Walker, P.C.

(57) ABSTRACT

A cleaning apparatus for cleaning a top of a beverage can. The top of the beverage can to be cleaned is inserted into a can-receiving cavity in the body of the cleaning apparatus, and the top of the can contactingly engages an actuator that opens a valve to a source of pressurized air. First air jets in communication with the air source expel air onto the lip around the top of the can and also onto the lip groove adjacent the lip, thereby cleaning the lip and the lip groove. Second air jets may also clean the top of the beverage can and its mouth. The cleaning is assisted by condensed moisture on the top of the can that is blown by the air expelled from the air jets. Venting ports allow air expelled from the air jets to escape from the can-receiving cavity.

3 Claims, 2 Drawing Sheets

APPARATUS FOR CLEANING A BEVERAGE CAN'S TOP

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO COMPACT DISC(S)

Not applicable.

BACKGROUND OF THE INVENTION

1. Field of the Invention

The present invention relates, in general, to sanitary cleaning devices for containers holding food and/or beverages, and in particular, to an apparatus for cleaning the top of a beverage can.

2. Description of Related Art

Beverage cans are well-known and are typically made of a metal such as aluminum or steel and are for holding a beverage such as, for example, beer, flavored carbonated soda water, fruit or flavored juices, and the like. These beverage cans come in a variety of can body diameters, but all have a top with an industry-standard top diameter and with a raised lip therearound, and typically the top also has a small lip groove concentric with the lip and immediately adjacent thereinside. When these beverage cans are shipped in cartons, stored in coolers, or transported in vehicles, the tops of the cans often become dirty, and the small lip groove in the can top immediately adjacent and inside the raised lip of the can is especially difficult to clean and can retain dirt and grime even after the top of the can is wiped with a rag, which is unable to reach down into the lip groove.

It is therefore desirable to have an improved cleaning apparatus that can quickly and efficiently clean the top of a beverage can and also the lip groove in the top of the can adjacent the raised lip of the can.

A preliminary patentability search in Class 134, Subclass 37; Class 15, Subclasses 304, 316.1 and 310; and Class 239, Digest 21, plus word text searching on the EAST database system at the U.S. Patent and Trademark Office produced the following patents, some of which may be relevant to the present invention:

Schöberg, U.S. Pat. No. 3,117,726, discloses a blow gun adapted for cleaning hollow openings.

Boylan, U.S. Pat. No. 3,665,547, discloses a blower having a shield that is received atop a filter, and that blows air through the filter upon operation of a valve.

Mead et al., U.S. Pat. No. 4,027,355, discloses a pneumatic mat having air jets that blow air when poppet valves are stepped upon.

Zakarian, U.S. Pat. No. 4,183,115, discloses a blow-off can washer that has a nozzle that blows air on the tops of cans.

Fauth, U.S. Pat. No. 4,324,265, discloses a blow dryer for cleaning the tops of beverage cans, in which a plurality of orifices blow air onto the tops of cans.

Biedermann et al., U.S. Pat. No. 4,364,147, discloses a blower for removing dust from surfaces, and shows a nozzle having an enlarged mouth.

Alkhato, U.S. Pat. No. 4,951,344, discloses a device for cleaning the top of a beverage can, and the downwardly-opening mouth of the device receives a beverage can.

Foreshew, U.S. Pat. No. 5,279,017, discloses air jets within hoods or caps for cleaning the tops of articles.

Sproule, U.S. Pat. No. 5,991,966, discloses using compressed air from nozzles to clean articles.

None of these references, either singly or in combination, disclose or suggest the present invention.

BRIEF SUMMARY OF THE INVENTION

The present invention is a cleaning apparatus for cleaning a top of a beverage can. The top of the beverage can to be cleaned is inserted into a can-receiving cavity in the body of the cleaning apparatus, and the top of the can contactingly engages an actuator that opens a valve to a source of pressurized air. A plurality of first air jets in communication with the source of pressurized air forcibly expel air onto the lip around the top of the can and also onto the lip groove adjacent the lip, thereby cleaning the lip and the lip groove. A plurality of second air jets may also clean the top of the beverage can and especially the mouth of the can. The cleaning process is assisted by condensed moisture on the top of the can that is blown by the air expelled from the first and second air jets. Venting ports in the body of the cleaning apparatus allow air expelled from the first and second air jets to escape from the can-receiving cavity.

It is an object of the present invention to provide an improved cleaning apparatus that can quickly and efficiently clean the top of a beverage can and also the lip groove in the top of the can adjacent the raised lip of the can.

DETAILED DESCRIPTION OF THE INVENTION

Figure 1:
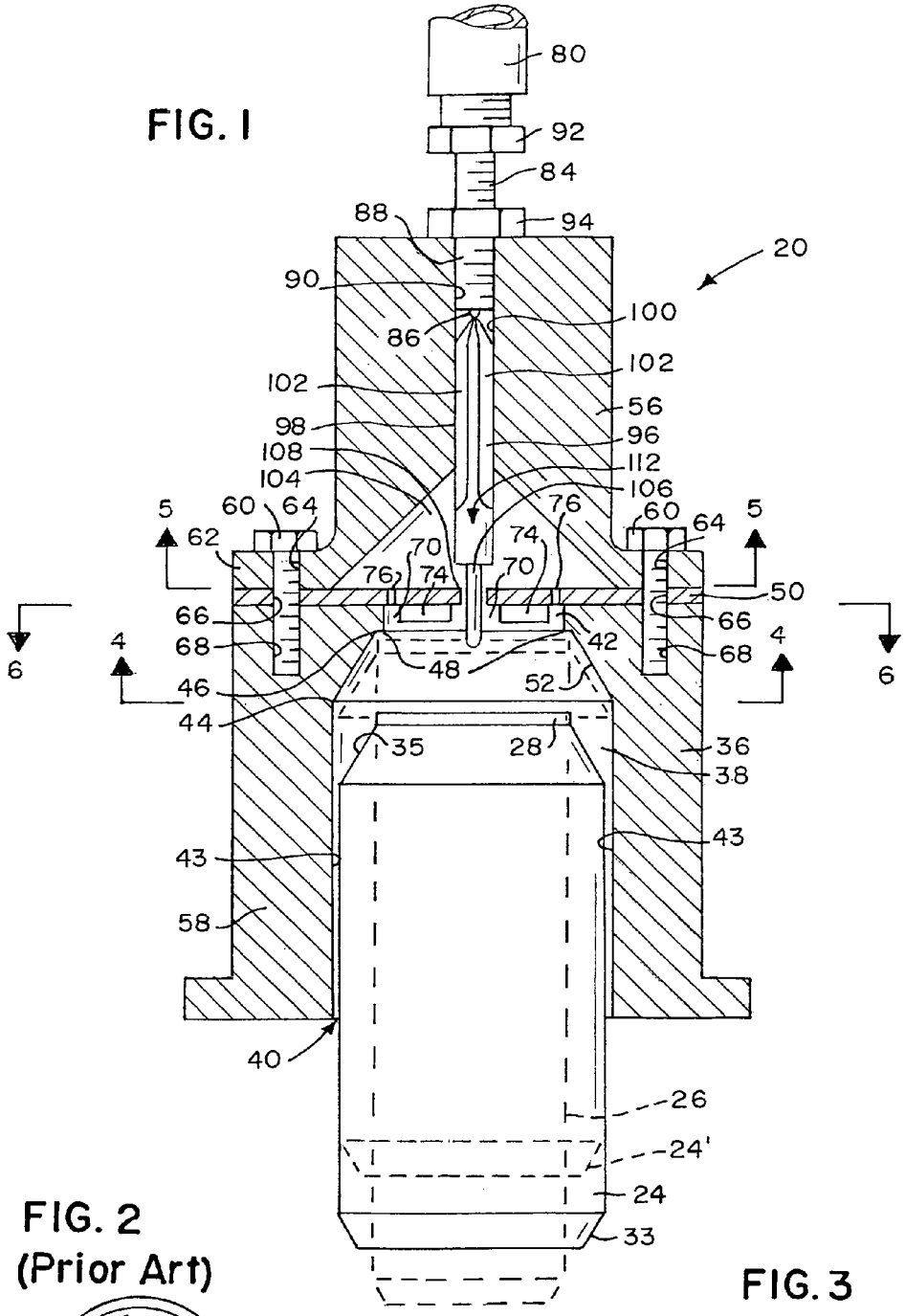
FIG. 1 is a side sectional view of the present invention taken along a diameter and showing the insertion of beverage cans of differing size.
Figure 2:
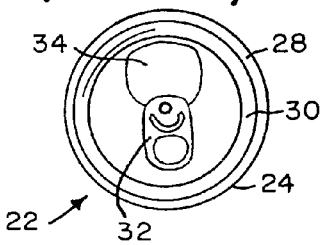
FIG. 2 (Prior Art)
FIG. 2 is a top plan view of the top of a prior art beverage can to be cleaned by the present invention.
Figure 3:
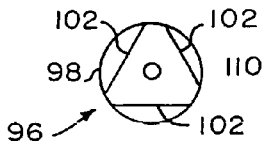
FIG. 3 is a top end view of the actuator pin of the present invention.
Figure 4:
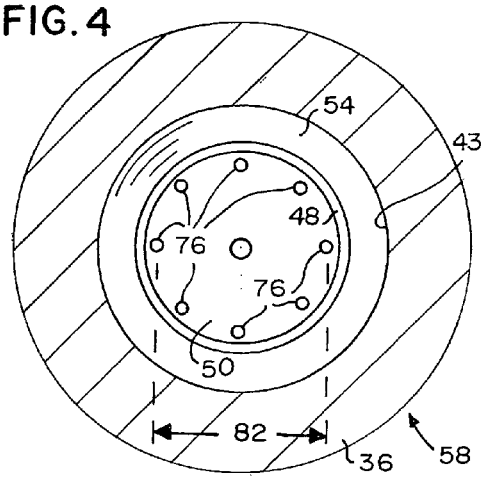
FIG. 4 is an upward-looking transverse sectional view of the present invention taken substantially along the line 4-4 shown in FIG. 1.
Figure 5:
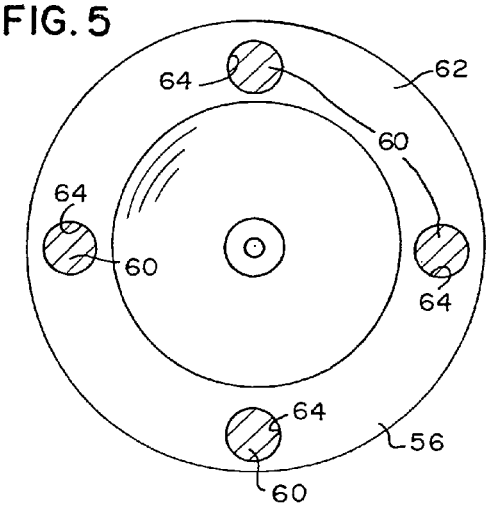
FIG. 5 is an upward-looking transverse sectional view of the present invention taken substantially along the line 5-5 shown in FIG. 1.
Figure 6:
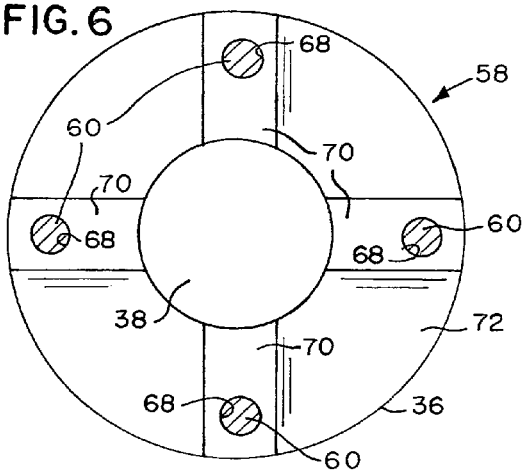
FIG. 6 is a downward-looking transverse sectional view of the present invention taken substantially along the line 6-6 shown in FIG. 1.
Figure 7:
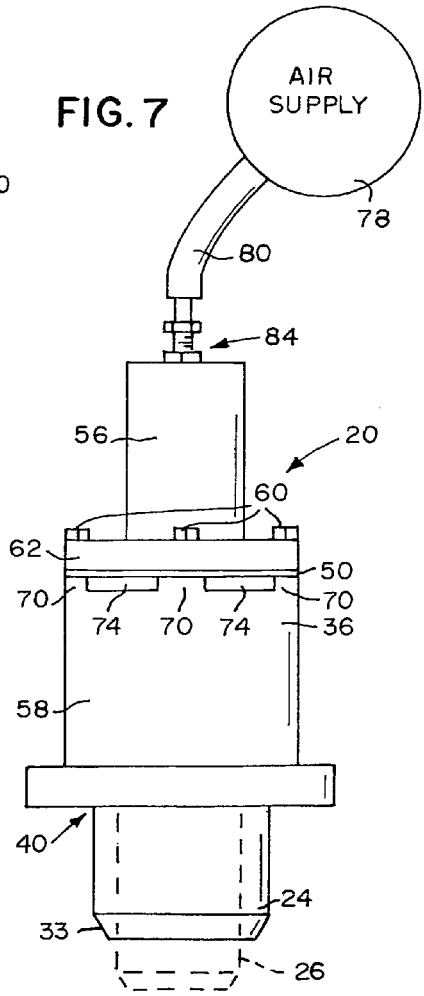
FIG. 7 is a side view of the present invention showing insertion of beverage cans of differing size.
Figure 8:
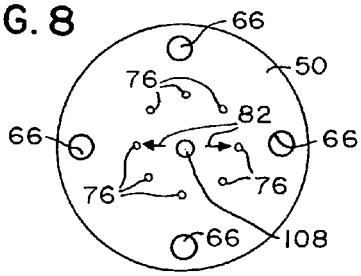
FIG. 8 is a plan view of the air jet plate, reduced in scale from FIGS. 4-6, showing the orientation of the first air jets and the axial guide hole for the bottom end of the actuator pin.

Referring to FIGS. 1-8, cleaning apparatus 20 of the present invention is understood to be a device for cleaning the top 22 of a well-known beverage can 24. Beverage cans 24 are well-known and are typically made of a metal such as aluminum or steel and are for holding a beverage such as, for example, beer, flavored carbonated soda water, fruit or flavored juices, and the like. Beverage cans 24 come in a variety of can body diameters such as the larger diameter of can 24 or the smaller diameter of can 26 shown in dotted outline, but all have a top 22 with an industry-standard top diameter and with a raised lip 28 therearound, and typically top 22 has a lip groove 30 concentric with lip 28 and immediately adjacent thereinside. The industry-standard top diameter of beverage cans 24, 26 is approximately 2.0625 inches (52.39 mm.) at lip 28. The top 22 of beverage can 24 also has a well-known lift-up tab 32 riveted thereto for opening a well-known can mouth sealing flap 34 in the top 22 of can 24 by lifting up on tab 32 and then pressing tab 32 back down to top 22 for drinking the beverage inside can 24. Can 24 typically also has a beveled bottom 33 and a beveled top 35, and the height of beverage can 24 may vary in a well-known manner as seen by comparison of the height of beverage can 24 with the height of beverage can 26.

Cleaning apparatus 20 is seen to include an apparatus body 36 having a can receiving cavity 38 therein adapted for receipt of can 24. Cavity 38 has an outwardly-opening mouth 40 into which the top 22 of can 24 is inserted, and then can 24 is pushed inwardly into cavity 38 and goes from a partially-inserted position shown in solid outline as can 24 to a more-inserted position shown in dotted outline as can 24'. Cavity 38 is generally cylindrically symmetric and has an inner cavity end 42 remote from mouth 40. Cavity 38 has sidewalls 43 that preferably provide a diameter of about 2.625 inches (6.67 cm.) from mouth 40 to a first cavity depth 44, at which point the diameter of cavity 38 then tapers to a diameter of about 2.140 inches (5.44 cm.) at a second cavity depth 46, where an inner cavity ledge 48 is formed as the diameter of cavity 38 changes to about 2.040 inches (5.18 cm.), and then the diameter of cavity 38 remains at about 2.040 inches (5.18 cm.) to the termination of cavity 38 at a vent plate 50. The shape of cavity 38 is seen to be adapted to receive a standard-sized can 24, with the tapered portion 52 of cavity 38 matching the beveled portion 35 of can 24. The shape of cavity 38 is to hold can 24 in position as the top of can 24 is being cleaned, but it is not essential that the sidewalls 43 of cavity 38 be close-fitting to can 24. In fact, it will be seen that there is a substantial gap between sidewalls 43 and smaller-diameter beverage can 26 when a smaller-diameter beverage can 26 is cleaned rather than the standard-sized beverage can 24. Inner cavity ledge 48 is provided to engage the raised lip 28 of top 22 of can 24 and thereby limit the full-insertion depth for can 24 into cavity 38 so as to space top 22 of can 24 a distance from vent plate 50 when can 24 is fully inserted into cavity 38.

Apparatus body 36 preferably comprises a body top portion 56 and a body bottom portion 58 with vent plate 50 being sandwiched between body top portion 56 and body bottom portion 58, and with body top portion 56 and body bottom portion 58 preferably being held together by a plurality of well-known bolts 60. Body top portion 56 preferably has an outwardly-extending flange 62 with a plurality of longitudinal holes 64 therethrough mating with holes 66 through vent plate 50 and also mating with threaded bores 68 in body bottom portion 58, and bolts 60 pass through holes 64 and 66 and are threadedly received into bores 68 to hold body top portion 56 and body bottom portion 58 together with vent plate 50 sandwiched therebetween. Bores 68 in body bottom portion 58 are positioned in raised radial plateaus 70 (seen best in FIG. 6 and also in FIGS. 1 and 7) on the top 72 of body bottom portion 58, and, when body top portion 56 and body bottom portion 58 are held together with vent plate 50 sandwiched therebetween, plateaus 70, being angularly spaced from each other, in concert with the top 70 of body bottom portion 58 and vent plate 50, define venting ports 74 substantially adjacent inner cavity end 42 and extending from within cavity 38 (seen best in FIG. 1) to the exterior of apparatus body 36 (seen best in FIG. 7), thereby permitting the escape of air from within cavity 38 to the exterior of apparatus body 36 as hereinafter described.

Apparatus body 36 further has a plurality of first air jets 76 opening into inner cavity end 42, with first air jets 76 being in communication with a well-known source of pressurized air 78 as by through a hose 80. Source of pressurized air 78 is preferably any non-flammable gas including, but not limited to, pressurized air from the earth's atmosphere or nitrogen or preferably carbon dioxide. First air jets 76 are preferably 1/16 inch (1.59 mm.) holes through vent plate 50 and are preferably arranged substantially in a first circle having a first diameter 82 (seen best in FIG. 4) and are oriented to expel air from the source of pressurized air 78 onto lip groove 30. Vent plate 50 is preferably formed from a 3.5 inch (8.89 cm.) circular piece of 0.026 inch (0.66 mm.) thick stainless steel, and it should be understood that the thickness of vent plate 50 and the size of the holes of first air jets 76 are exaggerated in the drawings for clarity. The number and size of first air jets 76 can be varied as desired.

Cleaning apparatus 20 further includes a valve 84 interposed between first air jets 76 and source of pressurized air 78 for selectively allowing air to pass from air source 78 through first air jets 76 and into inner cavity end 42. Preferably valve 84 is a well-known "Schrader valve" such as those manufactured by DynaQuip Controls, 10 Harris Industrial Park, St. Clair, Mo. 63077, and valve 84 opens and allows air to pass therethrough when its valve needle or stem 86 is depressed so that it reciprocates into the valve, thereby causing a plug pin inside the valve to open the valve for passage of air therethrough in a manner well known by those skilled in the art. Valve 84 preferably has a threaded end 88 that is threadedly received into a threaded hole 90 in apparatus body top portion 56 as seen best in FIG. 1, and, after valve 84 has been screwed into hole 90 a desired depth as by using a wrench applied to nut portion 92 of valve 84, a nut 94 received around threaded end 88 can be tightened against body top portion 56 so as to keep valve 84 at the desired depth into body top portion 56.

Cleaning apparatus 20 further includes an actuator 96 extending into cavity 38 and operably connected to valve 84 for actuation of valve 84 when actuator 96 is contacted by can 24. Preferably actuator 96 is an actuator pin 98 axially disposed within cavity 38 and mounted for longitudinal reciprocation with respect to apparatus body 36 along the cavity's axis. Actuator pin 98 is received within an axial bore 100 in apparatus body top portion 56 and has cut-away side portions 102 that allow air to pass through bore 100 and past actuator pin 98 and into a downwardly-opening conical chamber 104 in apparatus body top portion 56 immediately above vent plate 50. Conical chamber 104 is seen to place first air jets 76 in communication with axial bore 100 that, in turn, is an extension of threaded hole 90 into which valve 84 is threadedly received, thereby placing first air jets 76 selectively in communication with air source 78 as valve 84 is opened and closed. Actuator pin 98 has a downwardly-extending axial finger 106 that passes through a centrally-located hole 108 through vent plate 50 and into cavity 38. As can 24 is inserted into cavity 38, finger 106 is contacted by the top of can 24 and caused to reciprocate upward, thereby causing the upper tip 110 of actuator pin 98 to depress the valve needle or stem 86 of valve 84, thereby causing valve 84 to open and allow pressurized air to flow from source 78 through first air jets 76, which expel the air directly onto the lip groove 30 of the top of can 24, thereby cleaning the top of the can and lip groove 30. Air and debris from can 24 is vented from cavity 38 out through venting ports 74, and can 24 may be rotated within cavity 38 to further expedite the cleaning. When can 24 has been cleaned for an acceptable period of time, it can be removed and examined. As can 24 is removed, actuator pin 98 will reciprocate downward and valve 84 will close, stopping the flow of air through first air jets 76. If further cleaning is needed, can 24 may be reinserted and the cleaning process can be repeated.

Actuator pin 98 is seen to be prevented from falling into cavity 38 because hole 108 of vent plate 50 is smaller than body portion 112 of actuator pin 98 above finger 106. The depth of valve 84 into apparatus body top portion 56 is adjusted so that actuator pin 98 properly contacts valve needle or stem 86 when the can is fully inserted and so that, when raised lip 28 rests on inner cavity ledge 48, valve needle or stem 86 is not excessively forced into valve 84 by tip 110 of actuator pin 98. Once this depth of valve 84 into apparatus body top portion 56 has been thus properly adjusted, nut 94 can be tightened against body top portion 56 so as to keep valve 84 at the desired depth into body top portion 56.

Figure 9:
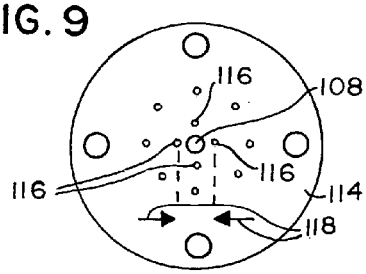
FIG. 9 is a plan view of an alternate embodiment of the air jet plate shown in FIG. 8, showing the addition of a plurality of second air jets for cleaning the center of a beverage can's top.

An alternate embodiment 114 of the vent plate, shown in FIG. 9, may instead be used with the present invention. It shall be understood that most aspects of vent plates 50 and 114 are substantially the same, and only the differences will be treated in detail, it being understood that similar structural features of the two embodiments perform similar functions, and the description vent plate 50 will suffice for those similar structural features of both vent plates.

Vent plate 114 additionally has a plurality of second air jets 116 that are also, like first air jets 76, in selective communication with air source 78 through valve 84. Second air jets 116 are arranged in a second circle that is concentric and inside the circle of first air jets 76, thereby causing the second circle to have a smaller diameter 118 than the diameter 82 of the circle in which first air jets 76 are arranged. Preferably, first air jets of vent plates 50 and 114 are arranged in a circle with a radius of about 0.980 inch (24.9 mm.) and second air jets of vent plate 114 are arranged in a circle with a radius of about ⅜ inch (9.525 mm.). Second air jets 116 are preferably 1/32 inch (0.79 mm.) holes and are oriented to expel air from air source 78 onto the top of beverage can 24 when the can 24 is contacting actuator pin 98 and valve 84 is opened. As was the case with vent plate 50, it should be understood that the size of the holes of second air jets 116 are exaggerated in the drawings for clarity, and the number and size of second air jets 116 can be varied as desired. Second air jets 116 thus are seen to clean the center region of the top 22 of can 24 and especially the can mouth sealing flap 34, and, as can 24 is rotated within cavity 38, lip groove 30 and can mouth sealing flap 34 are cleaned of debris.

The cleaning process is assisted by condensed moisture on the top of the can that is blown by the air expelled from first and second air jets 76 and 116.

Apparatus body top portion 56 and apparatus body bottom portion 58 are preferably made of any substantially rigid material. A prototype has been constructed and found to operate successfully made of machined aluminum for the apparatus body top and bottom portions 56 and 58, but preferably apparatus body top and bottom portions 56 and 58 should be made out of molded plastic for light weight and lower manufacturing costs.

Although the present invention has been described and illustrated with respect to a preferred embodiment and a preferred use therefor, it is not to be so limited since modifications and changes can be made therein which are within the full intended scope of the invention.

I claim:

1. A cleaning apparatus for cleaning a top of a beverage can, said top of said beverage can having a lip therearound and a lip groove concentric with said lip and adjacent thereto, said cleaning apparatus comprising:

(a) an apparatus body, said apparatus body having a can-receiving cavity therein adapted for receipt of said top of said beverage can, said cavity having an outwardly-opening mouth and having an inner cavity end remote from said mouth with an inner cavity sidewall around said inner cavity end; said apparatus body having a plurality of first air jets opening into said inner cavity end, said first air jets being in communication with a source of pressurized air and being arranged substantially in a first circle having a first diameter; said apparatus body further having a plurality of venting ports substantially adjacent said inner cavity end and extending radially through said inner cavity sidewall from within said cavity to said apparatus body's exterior to permit escape of air from said cavity;

(b) a valve interposed between said first air jets and said source of pressurized air for selectively allowing air to pass from said source of pressurized air through said first air jets into said inner cavity end; and (c) an axially-disposed actuator pin mounted for reciprocation with respect to said apparatus body and extending into said cavity and operably connected to said valve for reciprocating actuation thereof when said actuator pin is contacted by said can;

said first air jets being oriented to expel air from said source of pressurized air onto said lip groove when said beverage can is contacting said actuator pin.

2. The cleaning apparatus as recited in claim 1, in which said apparatus body comprises a body top portion and a body bottom portion and a vent plate sandwiched between said body top portion and said body bottom portion, and said first air jets are holes through said vent plate; and said actuator pin extends axially through said vent plate into said cavity.

3. The cleaning apparatus as recited in claim 2, in which said vent plate further has a plurality of second air jets being in selective communication with said source of pressurized air through said valve; said second air jets being arranged within said first circle; said second air jets being oriented to expel air from said source of pressurized air onto said top of said beverage can when said beverage can is contacting said actuator pin.

* * * * *